US006158182A

United States Patent [19]

Biebuyck

[11] Patent Number: 6,158,182

[45] Date of Patent: Dec. 12, 2000

[54] BUILDING CURTAIN WALL

[75] Inventor: Lawrence F. Biebuyck, Garland, Tex.

[73] Assignee: Butler Manufacturing Co., Kansas City, Mo.

[21] Appl. No.: 09/063,504

[22] Filed: Apr. 21, 1998

[51] Int. Cl.[7] ..... E04H 1/00

[52] U.S. Cl. ..... 52/235; 52/204.53; 52/212; 52/770

[58] Field of Search ..... 52/235, 211, 212, 52/204.53, 764, 770, 784

[56] References Cited

U.S. PATENT DOCUMENTS

| | | | |
|---|---|---|---|
| 3,932,974 | 1/1976 | Wright . | |
| 4,619,092 | 10/1986 | Kaminaga | 52/235 |
| 4,724,637 | 2/1988 | Evans . | |
| 4,799,344 | 1/1989 | Francis . | |
| 4,803,820 | 2/1989 | Metrick . | |
| 4,817,351 | 4/1989 | Michlovic | 52/235 |
| 4,873,806 | 10/1989 | Jeschke . | |
| 4,984,400 | 1/1991 | Bockmiller | 52/235 X |
| 4,996,809 | 3/1991 | Beard . | |
| 5,065,557 | 11/1991 | Laplante et al. | 52/235 |
| 5,077,947 | 1/1992 | Takeda | 52/235 |
| 5,185,979 | 2/1993 | Azzimonti . | |
| 5,252,154 | 10/1993 | Hoffman . | |
| 5,253,459 | 10/1993 | Parinas et al. | 52/235 |
| 5,333,428 | 8/1994 | Taylor et al. . | |
| 5,354,410 | 10/1994 | Cohen et al. . | |
| 5,546,713 | 8/1996 | Voegele, Jr. et al. | 52/235 X |
| 5,560,149 | 10/1996 | Lefevre . | |
| 5,592,795 | 1/1997 | Rinehart et al. | 52/235 |
| 5,746,032 | 5/1998 | Koike et al. | 52/235 X |
| 5,839,236 | 11/1998 | Frey | 52/235 |

OTHER PUBLICATIONS

"HP–400 Systems—¼" Glazing", Vistawall Architectural Products, Apr. 1989, 1 page.

*Primary Examiner*—Carl D. Friedman
*Assistant Examiner*—Brian E. Glessner
*Attorney, Agent, or Firm*—Jenkens & Gilchrist, A Professional Corporation

[57] ABSTRACT

An improved building curtain wall, including improved apparatus and methods for assembling and anchoring curtain walls, are disclosed. The curtain wall, apparatus, and methods each utilize a structural member having a first section for supporting a panel member, and a second section for securing to a fixed structure. The second section has a base and a first hole formed through the base. The curtain wall, apparatus, and methods also each utilize an anchor member, received within the second section, and having a second hole formed therethrough. The present invention eliminates labor intensive and error prone steps in the installation of a curtain wall; reduces the material costs of the curtain wall; and allows the current wall to be used in high stress applications such as hurricane force winds.

33 Claims, 6 Drawing Sheets

BUILDING CURTAIN WALL

FIELD OF THE INVENTION

The present invention pertains to curtain walls used for building exteriors and, more particularly, but not by way of limitation, to improved apparatus and methods for assembling and anchoring such curtain walls.

HISTORY OF THE RELATED ART

Curtain walls are typically constructed of extruded aluminum frame support members having generally U-shaped channels for supporting a plurality of panel members that serve as the exterior of a building. Such panel members are most often panes of glass, but other paneled building materials such as aluminum, granite, slate, or concrete are also utilized. Such panel members are often of identical size and shape. However, near doors, opening windows, or other access points into the building, panel members of different sizes and shapes may be utilized.

More specifically, such curtain walls generally include a horizontal sill member having an upwardly facing U-shaped channel at the bottom of a wall section, a horizontal head member having a downwardly facing U-shaped channel at the top of a wall section, and a plurality of vertical mullions running between the sill and head members. Panel members are supported by the U-shaped channels of the sill member and the head member, and the vertical joints between adjacent panel members are formed at the mullions. Typically, the mullions are disposed interiorly of the sill member, the head member, and the panel members so that only the joint between adjacent panel members, and not the mullions themselves, are visible from the exterior of the building.

Referring now to FIG. 1, a schematic, cross-sectional view of a sill member 10 of an exemplary, conventional curtain wall is shown. Sill member 10 secures a curtain wall to a concrete slab 12. Although not shown in FIG. 1, a head member similar to sill member 10 secures the curtain wall to a concrete slab between floors of a building or other building structure, and a plurality of mullions span between sill member 10 and the head member. Sill member 10 is typically formed as an integral aluminum extrusion. Sill member 10 generally includes a channel section 14, an anchoring section 16 disposed interiorly of channel section 14, and a cover 18.

Channel section 14 and cover 18 cooperate to secure a panel member 20 to sill member 10. More specifically, channel section 14 includes a base 14*a* and two legs 14*b* and 14*c* that form a upwardly facing U-shaped channel. A support member 22 rests on the top surface of base 14*a*. Leg 14*b* has a groove 24 proximate the upper end of its interior surface, and leg 14*c* has a support surface 26 proximate the upper end of its interior surface. Cover 18 has a downwardly depending resilient leg 28 that engages a groove 30 on the exterior surface of leg 14*c*. Cover 18 also has a tongue 32. Panel member 20 is supported within channel section 14 via setting block 34 and resilient gaskets 36 and 38. Setting block 34 is disposed on the top surface of support member 22. Resilient gasket 36 has a tongue 36*a* that engages groove 24 of leg 14*b*. Resilient gasket 36 is typically pre-installed in groove 24 of leg 14*b* during manufacturing of sill member 10. Resilient gasket 38 has a groove 38*a* that engages tongue 32 of cover 18 and a surface 38*b* that mates with surface 26 of leg 14*c*. Channel section 14 further includes a plurality of support legs 40 below base 14*a*.

Anchoring section 16 includes a base 16*a*, a leg 16*b*, and a plurality of support legs 42 below base 16*a*. Base 16*a* has a plurality of holes 44 spaced along its length for receiving bolts or fastening means 46, and the diameter of each hole 44 is substantially identical to the diameter of a threaded shank 46*a* of each bolt 46. Leg 16*b* has a groove 48 for receiving a tongue 49 of cover 18.

The following technique is typically used to install a panel member 20 of such a conventional curtain wall. First, sill member 10 is laid on a shim 56 in the proper position on slab 12 and is used as a template to drill holes into slab 12 for each bolt 46. One should note that shim 56 does not run continuously along the length of sill member 10. Instead, shim 56 is used at low points of slab 12 to level sill member 10, if necessary. Second, sill member 10 is removed from shim 56, and a hole 50 with a larger diameter is drilled in the place of each of the holes drilled using sill member 10. Third, a structural insert 52 is secured within each of holes 50 via epoxy or other conventional means. Each insert 52 has an internally threaded hole 54 for receiving bolts 46. A preferred structural insert 52 is sold by HILTI® of Tulsa, Okla. Fourth, sill member 10 is repositioned on shim 56 and secured to slab 12 using bolts 46. Fifth, a sealant 58 is disposed on slab 12 along both the exterior and interior sides of shim 56. Sixth, a head member similar to sill member 10 is secured to part of the building structure using the above-described techniques. Seventh, vertical mullions are secured between sill member 10 and the head member at appropriate intervals along the curtain wall. Eighth, support member 22 is disposed on base 14*a* of sill member 10, and setting block 34 is disposed on support member 20. Ninth, panel member 20 is then installed from the exterior of the building, typically first being tilted into the channel section of the head member, and then being dropped into channel section 14 of sill member 10. Tenth, cover 18 is installed in sill member 10, and a glazing stop is installed in the head member of the curtain wall. Eleventh, resilient gasket 38 is disposed on tongue 32 of cover 18 of sill member 10, and a similar gasket is disposed on the tongue of the glazing stop of the head member.

Of course, multiple panel members 20 are typically arranged side-by-side and are secured and sealed between sill member 10 and the head member in this manner, with their vertical joint overlapping at a mullion. This vertical joint must then be sealed from both the interior and exterior of the building using both resilient gaskets and/or structural silicone.

While such curtain walls, and other conventional curtain walls, have proved to be reliable commercial building systems, they suffer from several drawbacks. For example, securing the sill members and the head members to their corresponding building structure requires multiple steps, increasing the cost of this process. In addition, installing the panel members at the building site is also a very labor intensive and expensive process. Furthermore, as the sill members and head members provide structural support for the panel members and mullions, the material costs for such members is fairly high in applications that require the support of heavy panel members, in applications such as modern skyscrapers that require a very large number of sill and head members, or in applications where the building must withstand stresses caused by very high winds, such as hurricane force winds. Therefore, a need exits in the construction industry for a reliable curtain wall system that addresses these limitations.

SUMMARY OF THE INVENTION

One aspect of the present invention comprises an apparatus for supporting a panel member of a curtain wall. The apparatus includes a structural member having a first section for supporting a panel member, and a second section for securing to a fixed structure. The second section includes a base and a first hole formed through the base. The apparatus also includes an anchor member, received within the second section, and having a second hole formed therethrough.

In another aspect, the present invention comprises a method of installing a curtain wall. The method includes the following steps. A structural member is provided having a first section for supporting a panel member, and a second section for securing to a fixed structure. The second section has a base and a plurality of first holes formed through and spaced along the base. A plurality of anchor members are provided. Each of the anchor members has a second hole formed therethrough. The anchor members are disposed within the second section proximate each of the first holes. The structural member is positioned on the fixed structure, and the first holes of the base and the second holes of the anchor members are utilized to secure the structural member to the fixed structure.

In a further aspect, the present invention comprises a curtain wall for a building. The curtain wall includes a first horizontal support member having a first section for supporting a panel member, and a second section for securing to a fixed structure. The second section has a base and a first hole formed through the base. The curtain wall also includes an anchor member, received within the second section, and having a second hole formed therethrough. The curtain wall also includes a second horizontal support member disposed in a generally parallel relationship with the first horizontal support member, and a mullion disposed in a generally perpendicular relationship to and coupled with the first and second horizontal support members. The curtain wall further includes a first generally rectangular panel member secured in the first section of the first horizontal support member on a first side, to the second horizontal support member on a second side, and to the mullion on a third side. The curtain wall still further includes a second generally rectangular panel member secured in the first section of the first horizontal support member on a first side, to the second horizontal support member on a second side, and to the mullion on a third side.

BRIEF DESCRIPTION OF THE DRAWINGS

For a more complete understanding of the present invention, and for further objects and advantages thereof, reference is made to the following description taken in conjunction with the accompanying drawings in which.

DETAILED DESCRIPTION OF THE PREFERRED EMBODIMENT

The preferred embodiment of the present invention and its advantages are best understood by referring to FIGS. 1–7 of the drawings, like numerals being used for like and corresponding parts of the various drawings.

Figure 1:
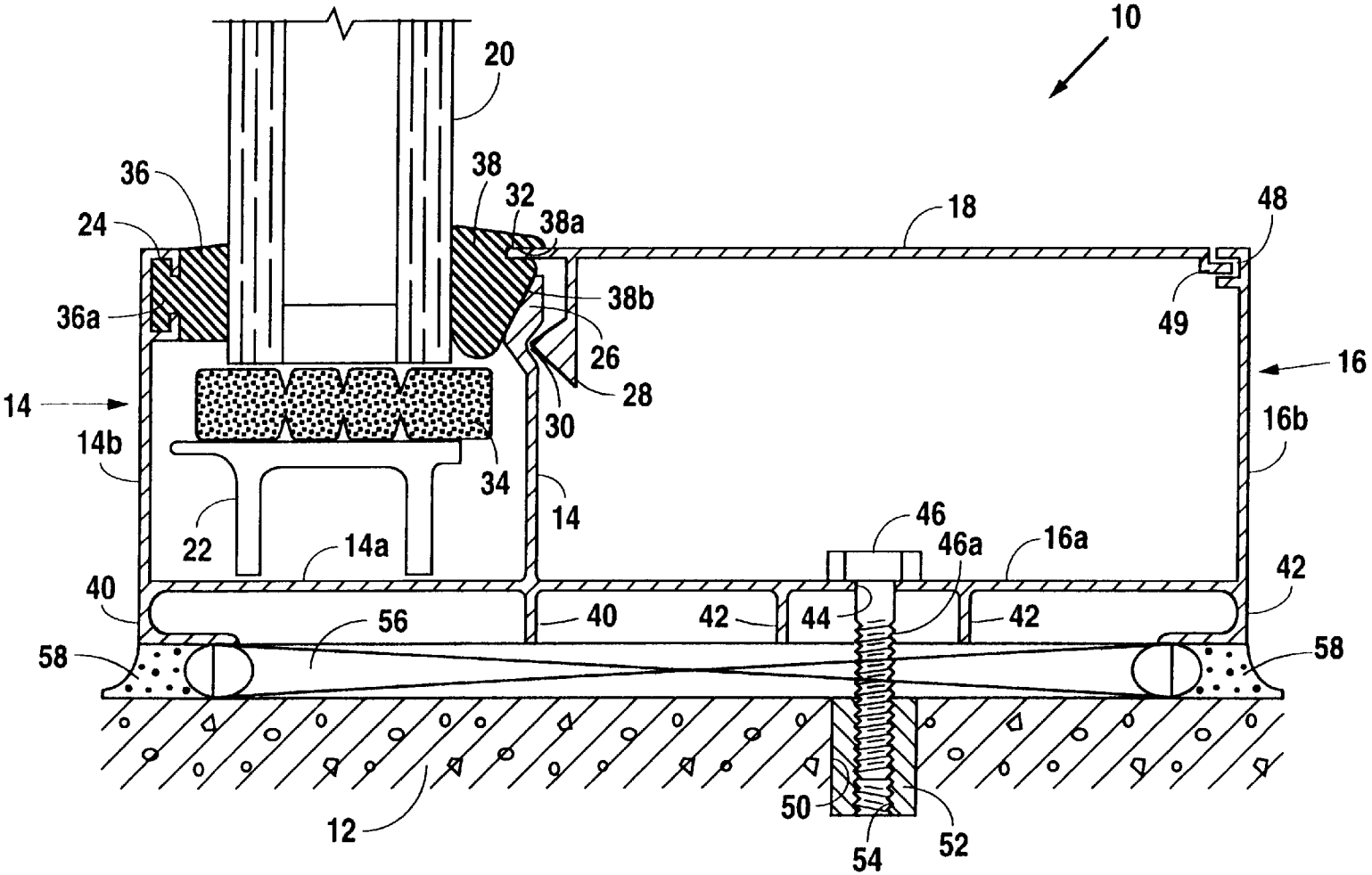
Fig. 1 (PRIOR ART)
FIG. 1 is a schematic, cross-sectional view of a sill member of a conventional curtain wall.
Figure 2:
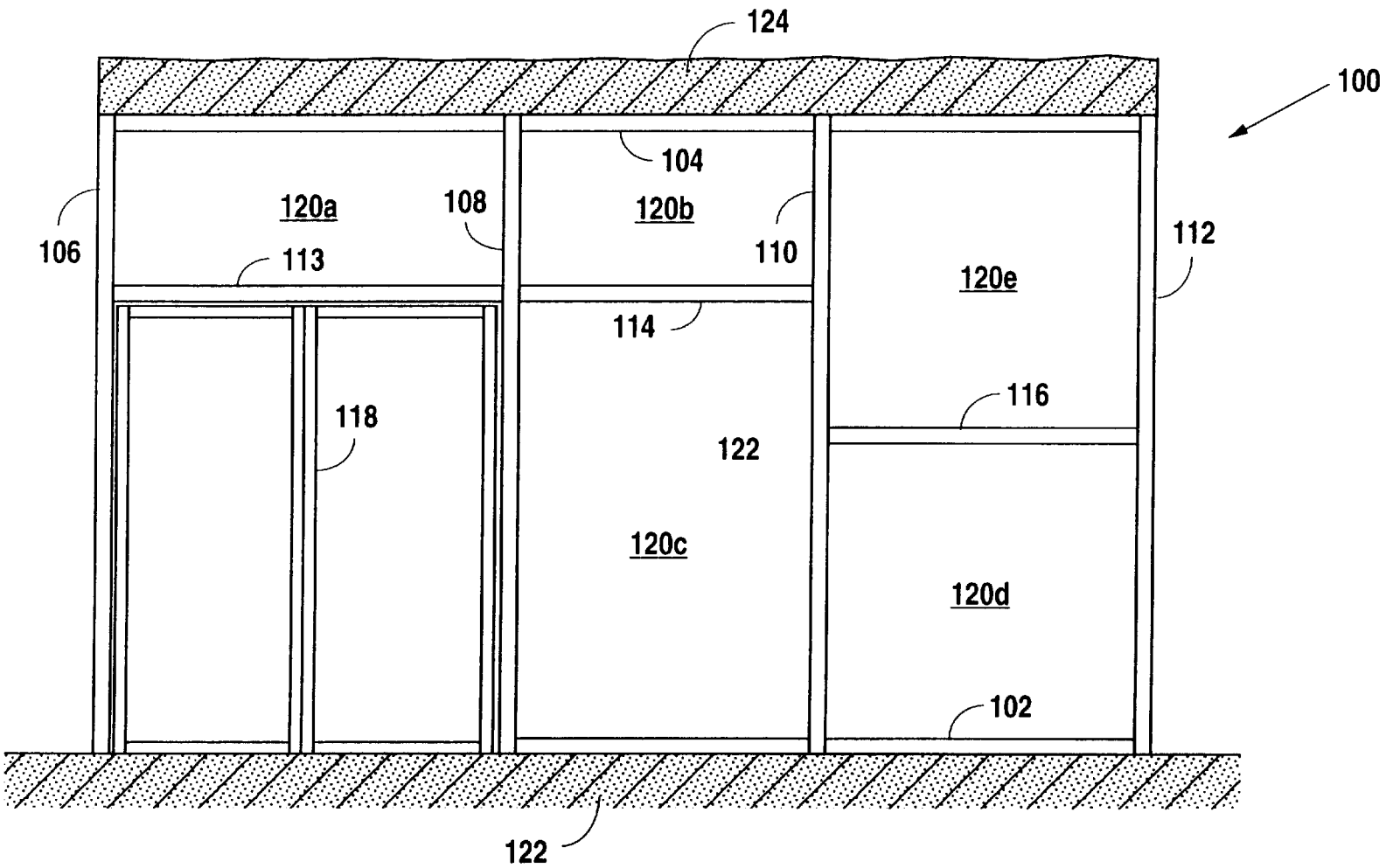
FIG. 2 is a schematic, elevational view of an exemplary curtain wall constructed in accordance with the principles of the present invention.
Figure 3:
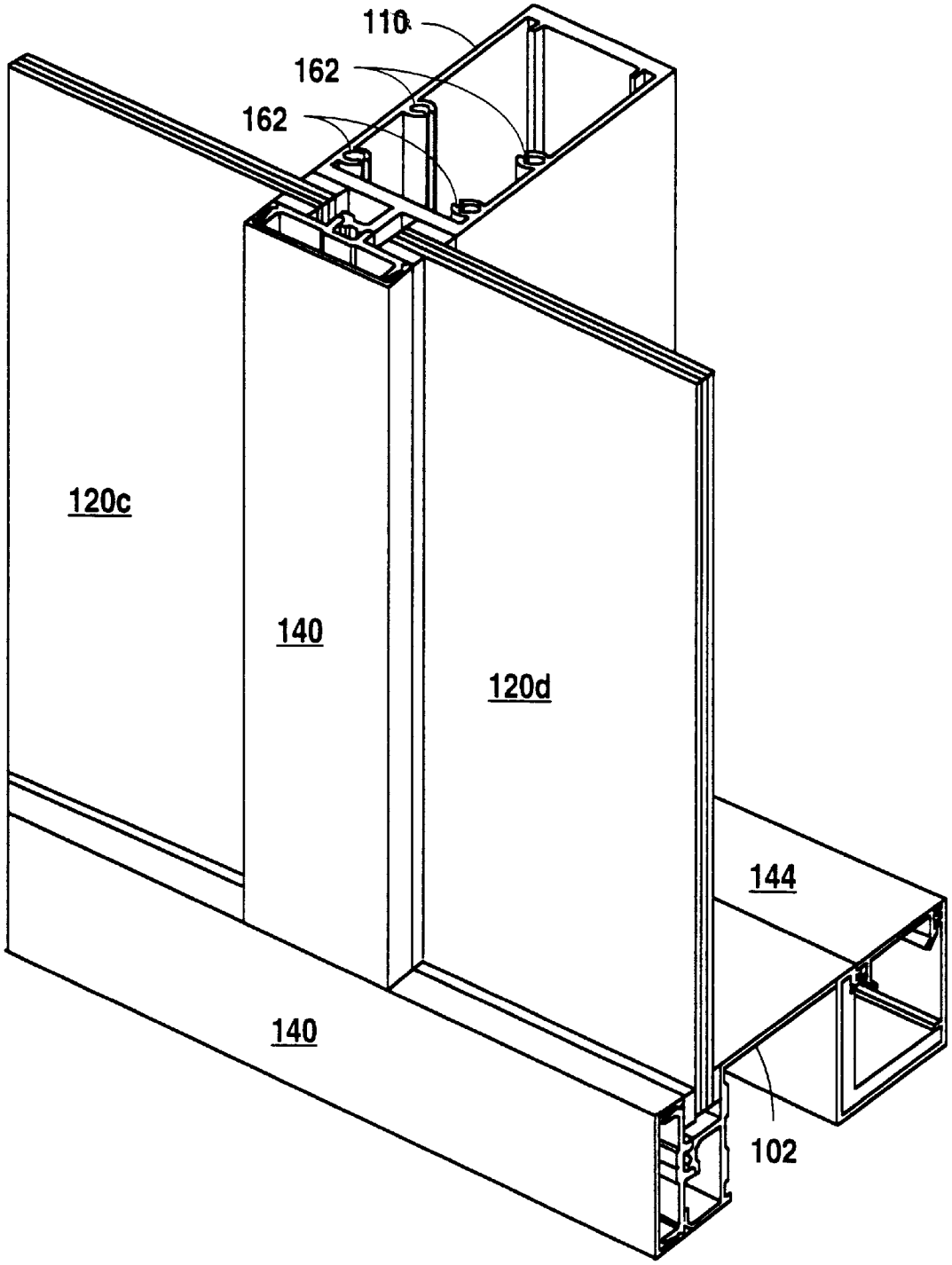
FIG. 3 is a detailed, schematic, perspective view of a portion of the curtain wall of FIG. 2 showing a sill member, a mullion, and the vertical joint between two panel members according to the preferred embodiment of the present invention.

Referring first to FIG. 2, a portion of an exemplary curtain wall 100 constructed in accordance with the principles of the present invention is shown. Curtain wall 100 generally includes a sill member 102; a head member 104; mullions 106, 108, 110, and 112; intermediate horizontal members 113, 114, and 116; a door 118; and panel members 120*a*–e. Sill member 102 anchors curtain wall 100 to a concrete slab 122 or other fixed structure on the ground, and head member 104 anchors curtain wall 100 to a concrete slab 124 or other fixed structure between floors of a building. Panel members 120*a–e* are secured by the adjacent sill member, head member, intermediate horizontal member, and/or mullions. Door 118 is secured to intermediate horizontal member 113, mullion 106, and mullion 108 using conventional techniques. Sill member 102; head member 104; mullions 106, 108, 110, and 112; and intermediate horizontal members 113, 114, and 116 are preferably formed as aluminum extrusions. Panel members 120*a–e* are preferably formed from glass, but other paneled building materials such as aluminum, granite, slate, or concrete may be utilized. As shown in FIG. 2, panel members 120*a–e* are of various sizes and shapes, principally due to the presence of door 118. Although not shown in FIG. 2, panel members 120*a –e* may be formed with an identical size and shape; intermediate horizontal members 113, 114, and 116 may be eliminated; and/or door 118 may be eliminated in other portions of curtain wall 100. In addition, curtain wall 100 may be employed between higher floors of a building, such as the second and third floor.

Referring now to FIGS. 3, 4, 5, and 6 in combination, a portion of curtain wall 100 showing the interconnection between sill member 102, mullion 110, panel member 120*c*, and panel member 120*d* is illustrated. Sill member 102 preferably includes a first base 126, a inner leg 128, a top 130, a inner leg 132, a second base 134, arid an outer leg 136. Although identified separately for convenience of description, each of these structures preferably comprise an integral piece of extruded aluminum. Sill member 102 preferably also includes a pressure plate 138, a pressure plate cover 140, a plurality of anchor members 142, and a cover 144.

First Base 126, inner leg 128, and pressure plate 138 cooperate to secure panel 120*d* to sill member 102. More specifically, inner leg 128 has an exterior shelf 146, and exterior shelf 146 preferably includes a downwardly depending portion 146*a*. Portion 146*a* has an attachment area 148 along its length. Pressure plate 138 has arms 148*a* and 148*b* that mate with portion 146*a* of shelf 146, and pressure plate 138 also has a plurality of clearance holes 150 along its length. A lower portion of pressure plate 138 preferably abuts first base 126. Setting block 152 is disposed on a top surface of shelf 146. Panel member 120*d* rests on top of setting block 152. A sponge gasket 154 is disposed between panel member 120*d* and an upper end of pressure plate 138, and a sponge gasket 156 is disposed between panel member 120*d* and an upper end of inner leg 128.

Sponge gaskets 154 and 156 preferably have an adhesive coating on their exterior surfaces. A preferred sponge gasket is sold by Norton Performance Plastics Corporation, Granville, N.Y. Screws 151, each preferably having a threaded shank 152*a* and a self drilling point 152*b*, are received within clearance holes 150 and attachment area 148. By tightening screws 151, panel member 120*d* is secured to sill member 102, and a weather seal is formed between pressure plate 138, panel member 120*d*, sponge gaskets 154 and 156, and inner leg 128.

Pressure plate cover 140 has resilient legs 192 and 194 that mate with grooves 196 and 198, respectively, in pressure plate 138. Therefore, cover 140 is removably fastened to pressure plate 138.

Figure 4:
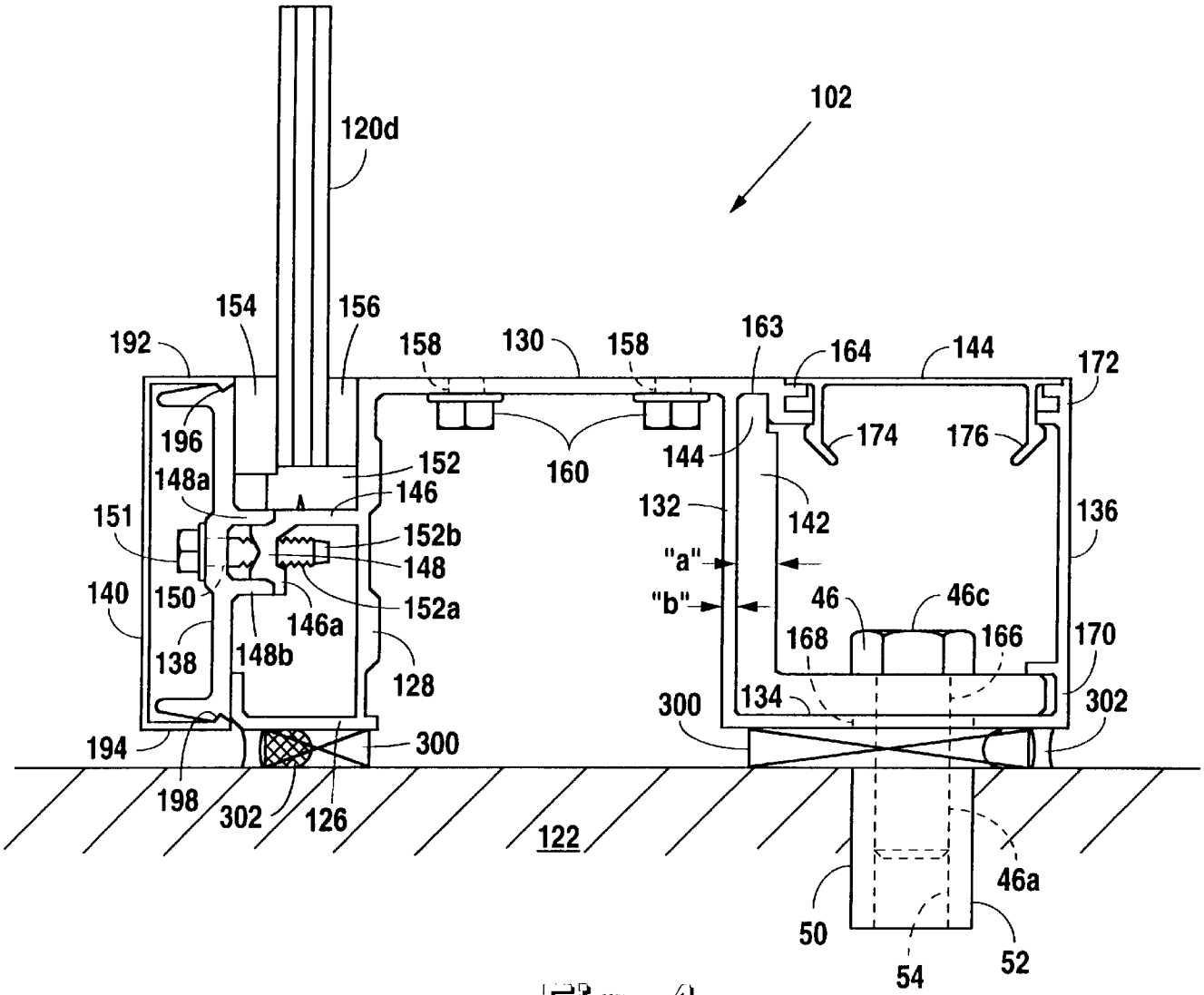
FIG. 4 is an enlarged, schematic, cross-sectional view of the sill member of FIG. 3.

Top 130 has a plurality of clearance holes 158 formed therethrough. Clearance holes 158 are for receiving threaded bolts 160, only the heads of which are shown in FIG. 4. As can be seen from FIGS. 3 and 6, bolts 160 are also received within extruded splines 162 formed within mullion 110 to secure mullion 110 to top 130 of sill member 102.

Figure 5:
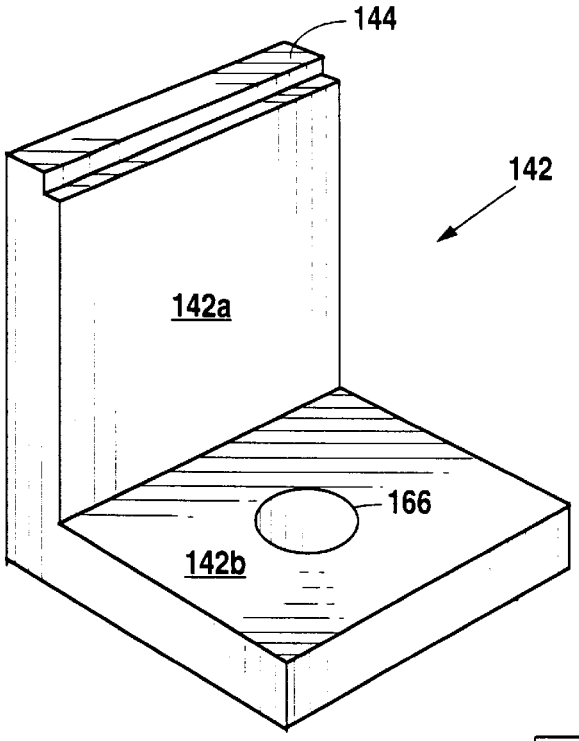
FIG. 5 is an enlarged, schematic, perspective view of the anchor member of the sill member of FIGS. 3 and 4.

Inner leg 132 preferably includes a groove 163 and a tongue 164 proximate its upper end. Groove 163 slidably receives a tongue 145 of anchor member 142, which is best shown in FIG. 5. As can be seen from FIG. 5, anchor member 142 preferably has a generally L-shaped cross-section, with an upper leg 142*a* and a lower leg 142*b*. Anchor member 142 is preferably formed from extruded aluminum, although conventional structural steels or steel alloys may alternatively be utilized. A hole 166 is formed through lower leg 142*b*. Although not shown in FIGS. 4 and 5, groove 163 may be sized so as to slidably receive an end of upper leg 142*a* without the need for tongue 145.

Second Base 134 includes a plurality of holes 168 spaced along its length. Each of holes 168 preferably has a diameter substantially identical to the outer diameter of structural insert 52. In addition, an anchor member 142 is preferably provided for each insert 52. Hole 166 of each anchor member 142 preferably has a diameter substantially identical to the diameter of shank 46*a* of bolt 46.

Outer leg 136 preferably includes a groove 170 proximate its lower end for slidably receiving an end of leg 142*b* of anchor member 142. outer leg 136 also has a tongue 172 proximate its upper end.

Cover 144 has two resilient legs 174 and 176 on opposite 5 sides. Resilient legs 174 and 176 mate with tongues 164 and 172 of legs 132 and 136, respectively, so as to removably secure cover 144 to sill member 102.

Head member 104 of curtain wall 100 preferably has a substantially identical structure, and is preferably formed from the same materials, as sill member 102. Therefore, using a pressure plate 138 and sponge gaskets, head member 104 may be secured to, and form a weather seal with, panel members 120*a*, 120*b* and 120*e*.

Figure 6:
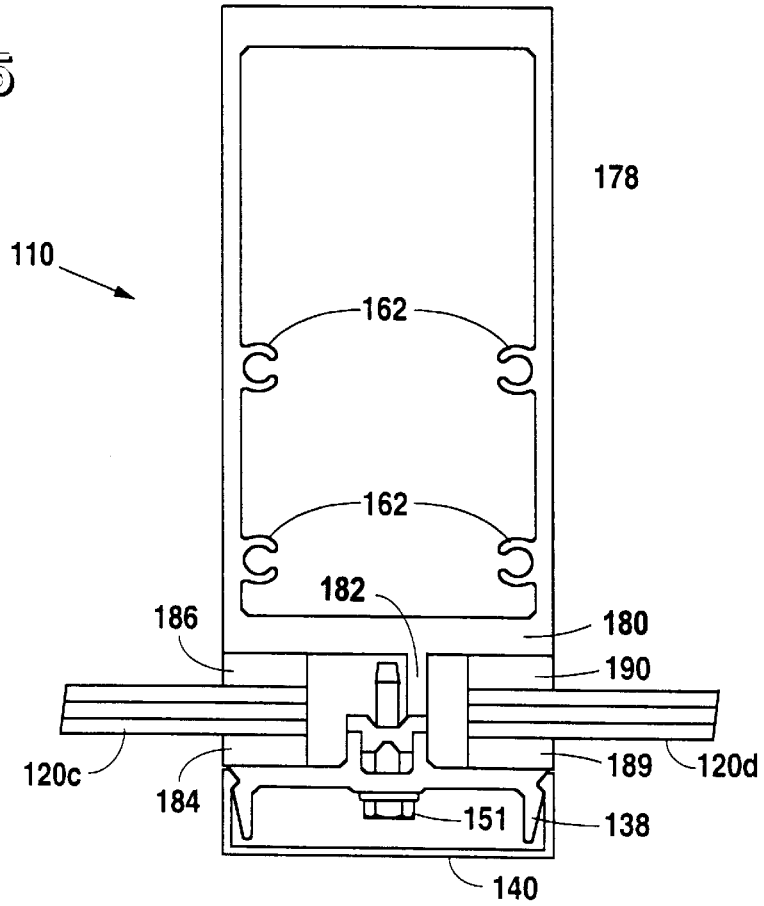
FIG. 6 is an enlarged, schematic, top sectional view of the mullion of FIG. 3.

As shown best in FIG. 6, mullion 110 includes a body 178 having extruded splines 162 on its interior surface. Body 178 is preferably formed from extruded aluminum. Body 178 has a surface 180 with an exterior shelf 182 formed thereon. Shelf 182 is preferably substantially identical to exterior shelf 146 of leg 128 of sill member 102, and therefore shelf 182 cooperates with a pressure plate 138 in substantially the same manner described hereinabove for shelf 146. A sponge gasket 184 is disposed between panel member 120*c* and pressure plate 138, and a sponge gasket 186 is disposed between panel member 120*c* and surface 180 of body 178. Similarly, a sponge gasket 188 is disposed between panel member 120*d* and pressure plate 138, and a sponge gasket 190 is disposed between panel member 120*d* and surface 180 of body 178. Sponge gaskets 184, 186, 188, and 190 are preferably substantially identical to sponge gaskets 154 and 156 of FIG. 4. By tightening screws 151, panel members 120*c* and 120*d* are secured to, and form a weather seal with, mullion 110. Cover 140 may then be fastened to pressure plate 138, as described hereinabove in connection with sill member 102. Mullions 106, 108, and 112 are preferably substantially identical to mullion 110.

Intermediate horizontal members 113, 114, and 116 preferably have a substantially identical structure, and are preferably made from the same materials, as mullion 110. Therefore, by way of example, using a pressure plate 138 and sponge gaskets, intermediate horizontal member 114 may be secured to, and form a weather seal with, panel members 120*b* and 120*c*. Intermediate horizonal members 113, 114, and 116 are preferably secured to mullions on each end using conventional shear blocks attached to each mullion, and by screwing each end of the horizontal members into a shear block.

The following technique is preferred to install curtain wall 100 within a building. Due to the design of the sill members, head members, mullions, and intermediate horizontal members of the present invention, curtain wall 100 may be assembled into a complete wall section as shown in FIG. 2 at the factory, rather than being totally assembled on-site at a building. Such off-site assembly results in a dramatic reduction in labor costs, a reduction in on-site modification and repair and an increased performance of curtain wall 100 due to the ideal assembly conditions and higher tolerances achieved in a controlled factory environment. Alternatively, entire wall sections of curtain wall 100 may be assembled on-site at the building, if desired. In either case, a panel member is installed within and secured to its adjacent sill member, head member, intermediate horizonal member, and/or mullions, using pressure plate 138 and sponge gaskets, as described hereinabove.

Next, a completed section of curtain wall 100 may be installed at the building site. First, curtain wall 100 is laid in the proper position on slab 122 and is made level by the use of shims 300, if necessary. Once in the proper position, all anchor members 142 within sill member 102 are slid within grooves 163 and 170 so as to reveal all holes 168 within base 134. Second, holes 50 are then drilled in slab 122 using holes 168 as a template. As each of holes 168 preferably has a diameter substantially identical to the outer diameter of structural insert 52, holes 50 are automatically correctly sized for inserts 52. Third, a structural insert 52 is secured within each of holes 50 using epoxy or other conventional means. Fourth, anchor members 142 are again slid within grooves 163 and 170 so that holes 166 of each anchor member 142 are aligned with holes 168 of leg 134 and holes 50 in slab 122. Fifth, bolts 46 are inserted through holes 166 and 168 and screwed into threaded holes 54 of inserts 52 to secure sill member 102 to slab 122. Sixth, a sealant 302 is disposed on slab 122 on both the exterior and interior sides of shim 300. Seventh, head member 104 is positioned on and secured to slab 124 using the above-described techniques.

Figure 7B:
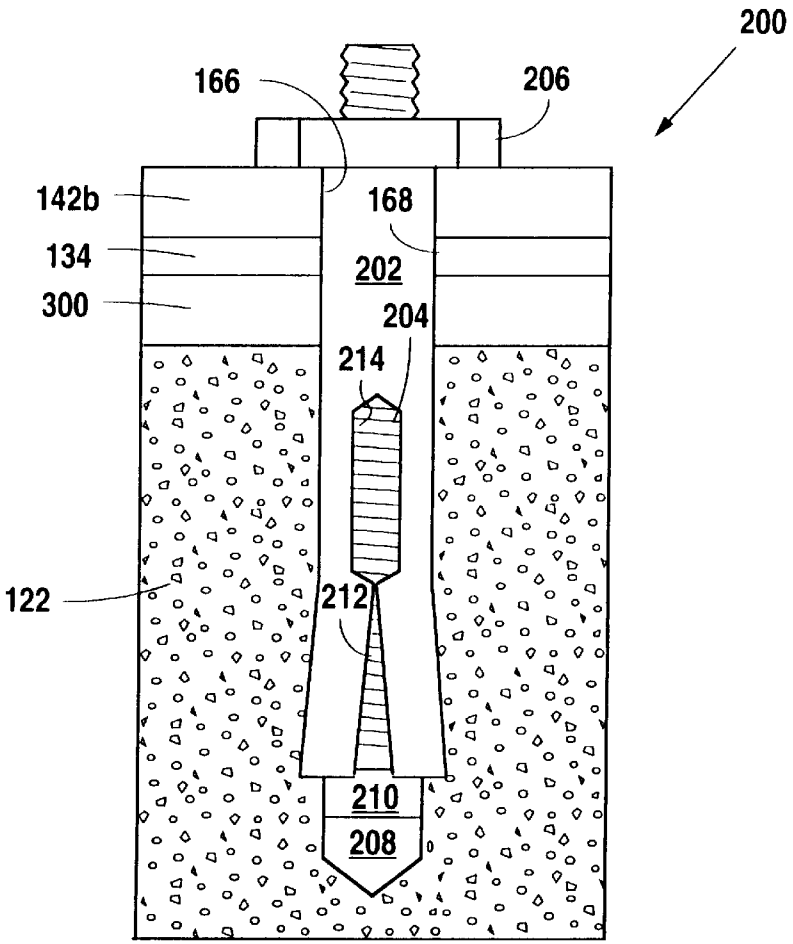
FIG. 7B is an enlarged, fragmentary, schematic cross-sectional view of the sleeve anchor of FIG. 7A in an expanded position.
Figure 7A:
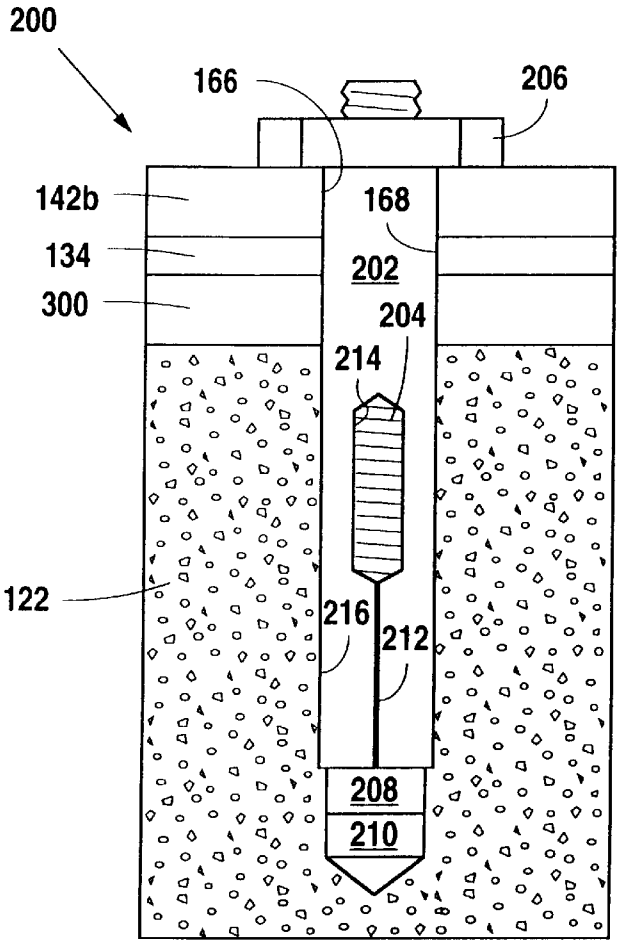
FIG. 7A is an enlarged, fragmentary, schematic cross-sectional view of a sleeve anchor used in the sill member of FIGS. 3 and 4.

Referring now to FIGS. 4, 7A, and 7B, a conventional sleeve anchor 200 that may be used in place of bolt 46 and structural insert 52 in connection with sill member 102 and head member 104 is illustrated. For convenience of illustration, sleeve anchor 200 is shown in FIGS. 7A and 7B in use with sill member 102. A preferred sleeve anchor 200 is sold by HILTI® of Tulsa, Okla.

Sleeve anchor 200 preferably includes a hollow sleeve 202, a threaded bolt 204 disposed within sleeve 202, and a nut 206 disposed on one end of bolt 204. Bolt 204 terminates in a sleeve stop 208 on its end opposite nut 206. Sleeve stop 208 preferably has an annular shoulder 210. Sleeve 202 is formed with at least one slot 212 running from a window 214 to an end of sleeve 202 proximate sleeve stop 208, and sleeve 202 preferably has a plurality of slots 212 and windows 214 spaced around its periphery. Sleeve 202 is preferably formed from structural steel. Holes 166 of leg 142*b* of anchor members 142, and holes 168 of base 134 of sill member 102, preferably each have a diameter substantially identical to the outer diameter of sleeve 202.

A completed section of curtain wall 100 may be installed at the building site using the following procedure. First, curtain wall 100 is laid in the proper position on slab 122 and is made level by use of shims 300, if necessary. Second, holes 216 are drilled within slab 122 using holes 166 and 168 as a template. As holes 166 and 168 preferably have a diameter substantially identical to the outer diameter of sleeve 202, holes 216 are automatically correctly sized for sleeve anchors 200. Third, as shown in FIG. 7A, sleeve anchors 200 are inserted into holes 166, 168, and 216. Fourth, as shown in FIG. 7B, nuts 206 are tightened against legs 142*b*. As such tightening occurs, each annular shoulder 210 of sleeve stops 208 and each nut 206 place sleeves 202 in compression, and slots 212 and windows 214 allow sleeves 202 to expand radially outward into slab 122. This outward radial expansion of sleeves 202 mechanically secures sleeve anchors 200, and thus sill member 102, to slab 122.

From the above, it will be appreciated that, unlike conventional sill member 10, anchor members 142 allow sill member 102 and head member 104 to be used as templates for the drilling of holes 50, or holes 216, without having to be removed from their respective slabs. Anchor members 142 therefore eliminate a labor intensive and error prone installation step, as compared to conventional curtain walls.

In addition, unlike cover 18 of conventional sill member 10, cover 144 of sill member 102 and head member 104 is not coupled to a gasket that supports a panel member. Therefore, where required by the applicable building code, an inspector may inspect each bolt 46 after curtain wall 100, including panel members 120*a–e*, is installed in a building, but before covers 144 are fastened to sill member 102 and head member 104.

Furthermore, anchor members 142 provide significant material cost savings as compared to conventional sill member 10 and other conventional curtain wall sill members. More specifically, unlike the sill members of conventional curtain walls, anchor members 142, not sill member 102 itself, preferably provide the majority of the structural support for curtain wall 100. As shown in FIG. 4, legs 142*a* and 142*b* of anchor members 142 may be formed with a larger cross-sectional thickness "a" than the cross-sectional thickness "b" of any of base 126, leg 128, top section 130, leg 132, base 134 or leg 136 of sill member 102. Anchor members 142 may also, or alternatively, be made of a stronger material than sill member 102. Therefore, anchor members 142 allow a reduction in the total amount of material required for sill member 102 for a given strength of sill member 102. Such advantages are equally applicable to head member 104 of curtain wall 100. Such construction results in a large material cost savings in applications such as modern skyscrapers that require a very large number of sill and head members. Anchor members 142 also allow curtain wall 100 to be successfully used in higher stress applications than conventional curtain walls. For example, anchor members 142 may provide sill member 102 and head member 104 with the additional strength necessary to withstand hurricane force winds. Of course, the number of structural inserts 52 or sleeve anchors 200, the number of corresponding anchor members 142, and the length of each anchor member 142 along base 134 may also be increased to add strength to curtain wall 100.

The present invention is illustrated herein by example, and various modifications may be made by a person of ordinary skill in the art. For example, numerous geometries, including the geometries of the sill members, head members, anchor members, and mullions could be altered to accommodate specific applications of the invention. As another example, although the present invention has been described above in connection with aluminum structural members for curtain walls, it is applicable to structural members made from other conventional building materials, such as metals other than aluminum, wood, or composite materials. As a further example, structural members similar to sill member 102 and head member 104 may be used in place of vertical mullions 106 and 112 when such structural members are required to be secured to adjacent building structure. As a further example, although the anchor members of the present invention are preferably slidably received within grooves of their respective sill member or head member, the anchor members may be received, or disposed, within a sill member or head member without such grooves. Of course, in such an embodiment, one does not have to slide the anchor members into such grooves from an open end of the sill member or a head member. As a final example, although the anchor members of the present invention are described above as having only one hole formed therethrough, the anchor members may be formed with more than one hole formed therethrough. In this embodiment, each of the holes in the anchor member may be utilized with a corresponding hole in a base of a sill member or head member to secure the sill member or head member to a fixed structure.

It is thus believed that the operation and construction of the present invention will be apparent from the foregoing description. While the method and apparatus shown or described have been characterized as being preferred it will be obvious that various changes and modifications may be made therein without departing from the spirit and scope of the invention as defined in the following claims.

In the claims:

1. A structural member for use in a curtain wall system in a building, said curtain wall system including at least one panel member, a head member, a sill member, and a plurality of mullions, said structural member comprising:

a substantially U-shaped first section constructed and arranged to receive and support the at least one panel member;

said substantially U-shaped first section having an inner leg, an outer leg, and a base;

said substantially U-shaped first section including a pressure plate forming said outer leg of said substantially U-shape;

a substantially U-shaped second section for securing the structural member to the building;

said substantially U-shaped second section having an inner leg, an outer leg, and a base;

said substantially U-shaped second section further including a base and a first hole formed through said base;

said inner leg of said substantially U-shaped second section being connected to said inner leg of substantially U-shaped first section; and a substantially U-shaped first section constructed and arranged to support the panel member;

said substantially U-shaped first section including a pressure plate forming one leg of said substantially U-shape;

a substantially U-shaped second section for securing the structural member to the building;

said substantially U-shaped second section including a base and a first hole formed through said base;

said substantially U-shaped second section being connected to said substantially U-shaped first section; and a substantially L-shaped anchor member constructed and arranged to be entirely received within said substantially U-shaped second section, said substantially L-shaped anchor member having a second hole, said second hole constructed and arranged to be co-axial with said first hole through said base when said substantially L-shaped anchor member is received within said substantially U-shaped second section.

2. The structural member is defined in claim wherein said substantially L-shaped anchor member has a larger cross-sectional thickness than the substantially U-shaped second section.

3. The structural member as defined in claim 1 wherein said substantially L-shaped anchor member is formed from a material having a higher strength than the material from which said structural member is formed.

4. The structural member as defined in claim 3 wherein said substantially L-shaped anchor member is formed from steel or a steel alloy.

5. The structural member as defined in claim further including:

a plurality of said first holes spaced along said base of said substantially U-shaped second section;

a plurality of said substantially L-shaped anchor members, said plurality of said substantially L-shaped anchor members received within said substantially U-shaped second section so that said second holes in said substantially L-shaped anchor members are co-axial with said first holes through said base of said substantially U-shaped second section.

6. The structural member as defined in claim 1 further including a plurality of sponge gaskets positioned along those surfaces of said substantially U-shaped first section that are constructed and arranged to support the panel member.

7. The structural member as defined in claim 1 further including a cover over said substantially U-shaped second section.

8. The structural member as defined in claim 1 further including means for coupling to a vertical mullion.

9. The structural member as defined in claim 1 further including a threaded fastener passing through said first hole and said second hole to threadably secure said structural member to the building.

10. A curtain wall section for use in a building, said curtain wall section comprising:

a substantially rectangular panel member;

a head member positioned at the top of said substantially rectangular panel member;

a substantially L-shaped anchor member received within said substantially U-shaped second section, said substantially L-shaped anchor member having a second hole, said second hole constructed and arranged co-axial with said first hole through said base.

11. The curtain wall section as defined in claim 10 wherein said substantially L-shaped anchor member has a larger cross-sectional thickness than said substantially U-shaped second section.

12. The curtain wall section as defined in claim 10 wherein said substantially L-shaped anchor member is formed of a material having a higher strength than the material from which said structural member is formed.

13. The curtain wall section as defined in claim 12 wherein said substantially L-shaped anchor member is formed from steel or a steel alloy.

14. The curtain wall section as defined in claim further including:

a plurality of said first holes spaced along said base of said substantially U-shaped second section;

a plurality of said substantially L-shaped anchor members, said plurality of said substantially L-shaped anchor members received within said substantially U-shaped second section so that said second holes in said substantially L-shaped anchor members are co-axial with said first holes through said base of said substantially U-shaped second section.

15. The curtain wall section as defined in claim 10 further including a plurality of sponge gaskets positioned along those surfaces of said substantially U-shaped first section which receives and supports said substantially rectangular panel member.

16. The curtain wall section as defined in claim 10 further including a cover over said substantially U-shaped second section.

17. The curtain wall section as defined in claim 10 further including means for coupling to a vertical mullion.

18. The curtain wall section as defined in claim 10 further including a threaded fastener passing through said first hole and said second hole to threadably secure said structural member to the building.

19. The curtain wall section as defined in claim 10 wherein said substantially rectangular panel member is made of glass.

20. A building comprising:

a plurality of curtain wall sections;

said substantially U-shaped second section further including a first hole formed through said base;

said inner leg of said substantially U-shaped second section being connected to said inner leg of said substantially U-shaped first section;

a substantially L-shaped anchor member received within said substantially U-shaped second section, said substantially L-shaped anchor member having a second hole, said second hole constructed and arranged co-axial with said first hole through said base.

21. The building as defined in claim 20 wherein said substantially L-shaped anchor member has a larger cross-sectional thickness than substantially U-shaped second section.

22. The building as defined in claim 20 wherein said substantially L-shaped anchor member is formed of a material having a higher strength than the material from which said structural member is formed.

23. The building as defined in claim 22 wherein said substantially L-shaped anchor member is formed from steel or a steel alloy.

24. The building as defined in claim 20 further including:

a plurality of said first holes spaced along said base of said substantially U-shaped second section;

a plurality of said substantially L-shaped anchor members received within said substantially U-shaped second section so that said second holes in said substantially L-shaped anchor members are co-axial with said first holes through said base of said substantially U-shaped second section.

25. The building as defined in claim 20 further including a plurality of sponge gaskets positioned along those surfaces of said substantially U-shaped first section which receives and supports said substantially rectangular panel member.

26. The building as defined in claim 20 further including a cover over said substantially U-shaped second section.

27. The building as defined in claim 20 further including means for coupling to said vertical mullion.

28. The building as defined in claim 20 further including a threaded fastener passing through said first hole and said second hole to secure said structural member to the building.

29. The building as defined in claim 20 wherein said substantially rectangular panel member is made of glass.

30. A method of installing a curtain wall system in a building, said curtain wall including a plurality of curtain wall sections having panel members, said method comprising the steps of:

providing a structural member having:

a substantially U-shaped first section constructed and arranged to support one panel member, said substantially U-shaped first section including an inner leg, a base, and an outer leg, said outer leg further including a pressure plate;

a substantially U-shaped second section for securing said structural member to the building, said substantially U-shaped second section having a base and a plurality of first holes formed therethrough, said first holes being spaced along said base, said substantially U-shaped second section being connected to said substantially U-shaped first section;

providing a plurality of substantially L-shaped anchor members, each of said substantially L-shaped anchor members having a second hole formed therethrough;

disposing said substantially L-shaped anchor members within said substantially U-shaped second section proximate each of said first holes through said base;

positioning said structural member on said building; and utilizing said first holes of said base and second holes of said substantially L-shaped anchor members to secure said structural member to the building with fasteners.

31. The method as defined in claim 30 wherein said step of utilizing said first holes of said base and second holes of said substantially L-shaped anchor members to secure said structural member to said fixed structure further comprises:

moving each of said substantially L-shaped anchor members within said substantially U-shaped second section so as to expose each of said first holes;

forming a plurality of third holes in the building utilizing said first holes as a template for positioning said third holes;

securing a structural insert to the building using said third holes;

moving said substantially L-shaped anchor members within said substantially U-shaped second section so that said second hole of each substantially L-shaped anchor member is co-axially aligned with one of said first holes;

disposing said fasteners through each of said first and second holes to secure said structural member to the building at said third hole.

32. The method as defined in claim 30 wherein said step of utilizing said first holes of said base and said second holes of said substantially L-shaped anchor members to secure said structural member to the building further comprises:

moving said anchor member with said second section at said second hole of each anchor member is aligned with one of said first holes;

forming a plurality of third holes in said building using said first and second holes as a template for locating said third holes; and securing a sleeve anchor within aligned ones of said first, second, and third holes to secure said structural member to the building.

33. The method as defined in claim 30 further comprising the step of pre-assembling the curtain wall including said structural member and said substantially L-shaped anchor members, before the said step of positioning said structural member.

* * * * *

UNITED STATES PATENT AND TRADEMARK OFFICE

CERTIFICATE OF CORRECTION

PATENT NO. : 6,158,182
DATED : December 12, 2000
INVENTOR(S) : Lawrence F. Biebuyck It is certified that error appears in the above-identified patent and that said Letters Patent is hereby corrected as shown below:

Column 4,
Line 46, replace "arid" with -- and --
Lines 45-46, replace "opposite 5 sides." with -- opposite sides. --

Column 8, line 44 through column 9, line 17,
Replace "Claim 1 in its entirety" with
-- 1. A structural member for use in a curtain wall system in a building, said curtain wall system including at least one panel member, a head member, a sill member, and a plurality of mullions, said structural member comprising:

a substantially U-shaped first section constructed and arranged to receive and support the at least one panel member;

said substantially U-shaped first section having an inner leg, an outer leg, and a base;

said substantially U-shaped first section including a pressure plate forming said outer leg of said substantially U-shape;

a substantially U-shaped second section for securing the structural member to the building;

said substantially U-shaped second section having an inner leg, an outer leg, and a base;

said substantially U-shaped second section further including a base and a first hole formed through said base;

said inner leg of said substantially U-shaped second section being connected to said inner leg of substantially U-shaped first section; and a substantially L-shaped anchor member received within said substantially U-shaped second section, said substantially L-shaped anchor member having a second hole, said second hole constructed and arranged co-axial with said first hole through said base. --

UNITED STATES PATENT AND TRADEMARK OFFICE

CERTIFICATE OF CORRECTION

PATENT NO. : 6,158,182
DATED : December 12, 2000
INVENTOR(S) : Lawrence F. Biebuyck It is certified that error appears in the above-identified patent and that said Letters Patent is hereby corrected as shown below:

Column 9,
Line 18, replace "claim" with -- claim 1 --
Line 28, replace "claim" with -- claim 1 --
Lines 54-63, replace "Claim 10 in its entirety" with --
10. A curtain wall section for use in a building, said curtain wall section comprising:

a substantially rectangular panel member;

a head member positioned at the top of said substantially rectangular panel member;

a sill member positioned at the bottom of said substantially rectangular panel member;

a pair of vertical mullions positioned along the sides of said substantially rectangular panel member;

said head member and said sill member further including;

a substantially U-shaped first section supporting said substantially rectangular panel member;

said substantially U-shaped first section having an inner leg, an outer leg, and a base;

said substantially U-shaped first section including a pressure plate forming said outer leg of said substantially U-shape;

a substantially U-shaped second section for securing a structural member to the building, said substantially U-shaped section having an inner leg, an outher leg, and a base;

said substantially U-shaped second section further including a base and a first hole formed through said base;

said inner leg of said substantially U-shaped second section being connected to said inner leg of said substantially U-shaped first section;

It is certified that error appears in the above-identified patent and that said Letters Patent is hereby corrected as shown below:

a substantially L-shaped anchor member received within said substantially U-shaped second section, said substantially L-shaped anchor member having a second hole, said second hole constructed and arranged co-axial with said first hole through said base. --

Column 10,
Line 8, replace "claim" with -- claim 10 --
Lines 36-47, replace "Claim 20 in its entirety" with
-- 20. A building comprising:

a plurality of curtain wall sections;

each of said plurality of curtain wall sections further including:

a substantially rectangular panel member;

a head member positioned at the top of said substantially rectuangular panel member;

a sill member positioned at the bottom of said substantially rectangular panel member;

a pair of vertical mullions positioned along the sides of said substantially rectangular panel member;

said head member and said sill member further including:

a substantially U-shaped first section supporting said substantially rectangular panel member;

said substantially U-shaped first section having an inner leg, an outer leg, and a base;

said substantially U-shaped first section including a pressure plate forming said outer leg of said substantially U-shape;

a substantially U-shaped second section securing the structural member to the building, said substantially U-shaped second section having an inner leg, an outer leg, and a base;

said substantially U-shaped second section further including a first hole formed through said base;

UNITED STATES PATENT AND TRADEMARK OFFICE

CERTIFICATE OF CORRECTION

PATENT NO. : 6,158,182
DATED : December 12, 2000
INVENTOR(S) : Lawrence F. Biebuyck It is certified that error appears in the above-identified patent and that said Letters Patent is hereby corrected as shown below:

said inner leg of said substantially U-shaped second section being connected to said inner leg of said inner leg of said substantially U-shaped first section;

a substantially L-shaped anchor member received within said substantially U-shaped second section, said substantially L-shaped anchor member having a second hole, said second hole constructed and arranged co-axial with said first hole through said base. --

Signed and Sealed this

Thirteenth Day of November, 2001

*Attest:*

Nicholas P. Godici

NICHOLAS P. GODICI

*Attesting Officer*

*Acting Director of the United States Patent and Trademark Office*